US011260653B2

(12) United States Patent
Martin et al.

(10) Patent No.: US 11,260,653 B2
(45) Date of Patent: Mar. 1, 2022

(54) CONFIGURING COMMUNICATION INTERFACES OF FLUID EJECTION DEVICES

(71) Applicant: HEWLETT-PACKARD DEVELOPMENT COMPANY, L.P., Spring, TX (US)

(72) Inventors: Eric Martin, Corvallis, OR (US); Vincent C Korthuis, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 301 days.

(21) Appl. No.: 16/336,572

(22) PCT Filed: Jan. 20, 2017

(86) PCT No.: PCT/US2017/014401
§ 371 (c)(1),
(2) Date: Mar. 26, 2019

(87) PCT Pub. No.: WO2018/136084
PCT Pub. Date: Jul. 26, 2018

(65) Prior Publication Data

US 2021/0283907 A1 Sep. 16, 2021

(51) Int. Cl.
*B41J 2/04* (2006.01)
*B41J 2/045* (2006.01)

(52) U.S. Cl.
CPC ..... *B41J 2/04541* (2013.01); *B41J 2/0458* (2013.01); *B41J 2/04581* (2013.01)

(58) Field of Classification Search
None
See application file for complete search history.

(56) References Cited

U.S. PATENT DOCUMENTS 5,724,086 A 3/1998 Mackin et al.
6,312,079 B1 11/2001 Anderson et al.
(Continued)

FOREIGN PATENT DOCUMENTS

WO WO-2016068884 6/2016
WO WO-2016089371 A1 6/2016
WO WO-2018071034 4/2018

OTHER PUBLICATIONS

Rice, H.W. et al., Next-generation Inkjet Printhead Drive Electronics, Jun. 1997, < http://www.hpl.hp.com/hpjournal/97jun/jun97a5.pdf >.

(Continued)

*Primary Examiner* — Erica S Lin
(74) *Attorney, Agent, or Firm* — Trop Pruner & Hu PC

(57) ABSTRACT

In some examples, a fluid ejection device includes a communication interface comprising a plurality of communication channel circuits capable of communicating over respective communication channels, and a configuration controller, responsive to an input, to selectively activate at least one communication channel circuit of the plurality of communication channel circuits, wherein different inputs to the configuration controller are to cause selective activation of different numbers of the plurality of communication channel circuits. The fluid ejection device further includes a nozzle controller responsive to data received through the activated at least one communication channel circuit to cause activation of at least one corresponding nozzle to eject fluid.

20 Claims, 6 Drawing Sheets

(56) References Cited

U.S. PATENT DOCUMENTS

| | | | | |
|---|---|---|---|---|
| 6,318,828 | B1 | 11/2001 | Barbour et al. | |
| 7,735,948 | B2 | 6/2010 | Walmsley et al. | |
| 7,802,862 | B2 | 9/2010 | Walmsley et al. | |
| 7,901,037 | B2 | 3/2011 | Walmsley et al. | |
| 8,770,685 | B2 | 7/2014 | Shepherd et al. | |
| 9,269,029 | B2 | 2/2016 | Sempere Agullo et al. | |
| 2002/0186265 | A1 | 12/2002 | Schloeman et al. | |
| 2005/0168511 | A1 | 8/2005 | Hu | |
| 2005/0225588 | A1* | 10/2005 | King | B41J 2/2139 347/19 |
| 2006/0023012 | A1 | 2/2006 | Han | |
| 2008/0204509 | A1* | 8/2008 | Drury | B41J 2/14209 347/44 |

OTHER PUBLICATIONS

Mcwilliams, J.L. et al., PPA Printer Controller ASIC Development, Jun. 1997, < http://www.undocprint.org/_media/formats/page_description_languages/hp_jornal_-_ppa_printer_controller_asic_programming_-_jun97a4.pdf >.

* cited by examiner

CONFIGURING COMMUNICATION INTERFACES OF FLUID EJECTION DEVICES

BACKGROUND

A printing system can include a printhead that has nozzles to dispense printing fluid to a print target. In a two-dimensional (2D) printing system, the target is a print medium, such as a paper or another type of substrate onto which print images can be formed. Examples of 2D printing systems include inkjet printing systems that are able to dispense droplets of inks. In a three-dimensional (3D) printing system, the target can be a layer or multiple layers of build material deposited to form a 3D object.

BRIEF DESCRIPTION OF THE DRAWINGS

Some implementations of the present disclosure are described with respect to the following figures.

Figure 1:
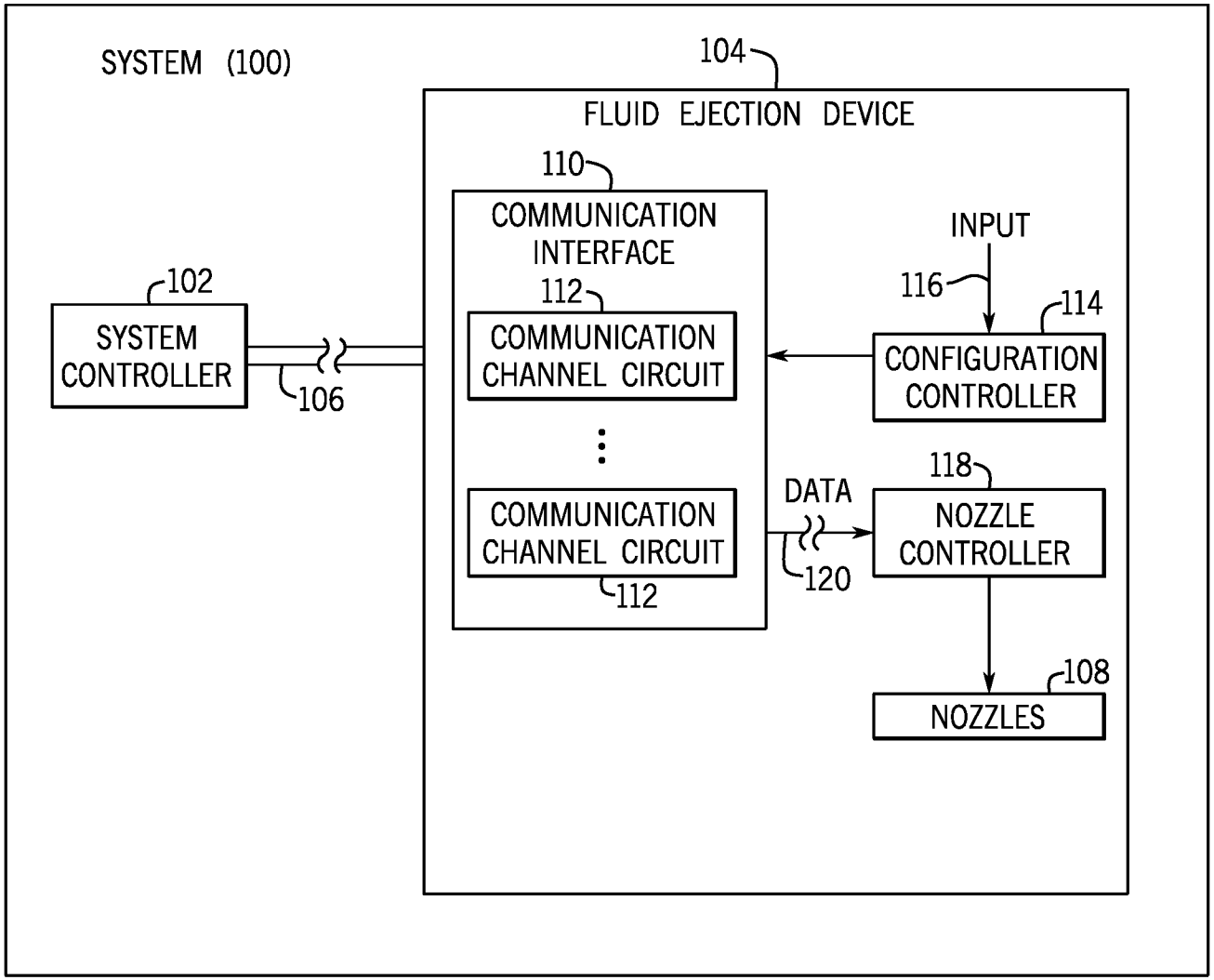
FIG. 1 is a block diagram of a system according to some examples.

Throughout the drawings, identical reference numbers designate similar, but not necessarily identical, elements. The figures are not necessarily to scale, and the size of some parts may be exaggerated to more clearly illustrate the example shown. Moreover, the drawings provide examples and/or implementations consistent with the description; however, the description is not limited to the examples and/or implementations provided in the drawings.

DETAILED DESCRIPTION

In the present disclosure, use of the term "a," "an", or "the" is intended to include the plural forms as well, unless the context clearly indicates otherwise. Also, the term "includes," "including," "comprises," "comprising," "have," or "having" when used in this disclosure specifies the presence of the stated elements, but do not preclude the presence or addition of other elements.

A printhead for use in a printing system can include nozzles that are activated to cause printing fluid droplets to be ejected from respective nozzles. Each nozzle includes an active ejection element that when activated causes ejection of a droplet of the printing fluid from a fluid ejection chamber in the nozzle. A printing system can be a two-dimensional (2D) or three-dimensional (3D) printing system. A 2D printing system dispenses printing fluid, such as ink, to form images on print media, such as paper media or other types of print media. A 3D printing system forms a 3D object by depositing successive layers of build material. Printing fluids dispensed by the 3D printing system can include ink, as well as fluids used to fuse powders of a layer of build material, detail a layer of build material (such as by defining edges or shapes of the layer of build material), and so forth.

In the ensuing discussion, the term "printhead" can refer generally to an overall assembly that includes a printhead die or multiple printhead dies mounted on a support structure, wherein a printhead die is used to dispense printing fluid towards a print target. A printhead can be part a print cartridge that can be removably mounted in a printing system. In other examples, a printhead can be part of a print bar, which can have a width that spans the width of a print target, such as a 2D print medium or a 3D target. In a print bar, the multiple dies of the printhead can be arranged along the width of the print bar. In further examples, a printhead can be mounted on a carriage of a printing system, where the carriage is moveable with respect to a print target.

Although reference is made to a printhead for use in a printing system in some examples, it is noted that techniques or mechanisms of the present disclosure are applicable to other types of fluid ejection devices used in non-printing applications that are able to dispense fluids through nozzles. Examples of such other types of fluid ejection devices include those used in fluid sensing systems, medical systems, vehicles, fluid flow control systems, and so forth.

A printhead die refers to a die that includes a substrate, nozzles formed on the substrate to eject fluids, and control circuitry on the substrate to control ejection of fluids from the nozzles. A printing system can include a printhead die or multiple printhead dies. Each printhead die can be coupled over a communication path to a print data path controller (or more simply, a "data path controller") of the printing system, which provides print data over the communication path to control ejection of fluids from the printhead die for printing onto a print target. The data path controller can also be referred to as a printer driver in some examples.

As used here, the term "controller" can refer to a hardware processing circuit, such as a microcontroller, a microprocessor, a core of a multi-core microprocessor, a programmable integrated circuit device, a programmable gate array, or any other type of hardware processing circuit. In further examples, a controller can include a combination of a hardware processing circuit and machine-readable instructions (software or firmware) executable on the hardware processing circuit. The data path controller of the printing system can be part of or separate from a printer controller that can be used to control additional features of the printing system, such as a motor, a heater, a fan, and other adjustable or controllable components of the printing system.

A manufacturer of printing systems can provide different printhead dies for different types of printing systems. Some printhead dies can be designed for higher end printing systems, which can perform printing at higher speeds. In such higher end printing systems, there can be a larger number of communication channels in a communication path between a data path controller and a printhead die. On the other hand, for lower end printing systems that can print at lower speeds, a smaller number of communication channels (such as one communication channel or a number of communication channels less than that used in a higher end printing system) can be employed in the communication path between a data path controller and a printhead die.

Having to provide different printhead dies with different designs for different types of printing systems can be expensive from both a design and development perspective (which involves the cost of designing and developing the different types of printhead dies) and a supply chain perspective (where it can be costly to maintain an adequate inventory of each type of printhead die for the different types of printing systems that can be made by the manufacturer).

The data path controllers in different types of printing system can vary. For higher end printing systems, the data path controllers can drive print data over a larger number of communication channels than data path controllers used in lower end printing systems. A data path controller that is able to support a larger number of communication channels can be more costly than a data path controller that is designed to operate with a smaller number of communication channels. As a result, if the same data path controller (which supports a larger number of communication channels) were to be employed in both lower end and higher end printing systems, then that can drive up the costs of the lower end printing systems.

In accordance with some implementations of the present disclosure, a configurable printhead die is provided that is able to be configured to operate with different communication paths that are used in different types of printing systems. The different communication paths used in the different types of printing systems can have different numbers of communication channels. When the configurable printhead die is used in a lower end printing system that has a data path controller that drives a smaller number of communication channels, a communication interface of the printhead die can be configured to use a smaller number of communication channels. On the other hand, when the configurable printhead die is used in a higher end printing system that has a data path controller that drives a larger number of communication channels, then the printhead die can be configured to operate with the larger number of communication channels.

More generally, a configurable fluid ejection device can be configured to operate with any of various different communication paths with different numbers of communication channels.

FIG. 1 is a block diagram of an example system 100, which can be a printing system or any other type of system that is able to dispense fluid to a target (not shown). The system 100 includes a system controller 102 and a fluid ejection device 104 that is coupled over a communication path 106 to the system controller 102. In examples where the system 100 is a printing system, the system controller 102 can be a data path controller, as discussed above. In other types of systems, the system controller 102 can be any other type of controller that is used for controlling the dispensing of fluid by nozzles 108 of the fluid ejection device 104. Although just one fluid ejection device 104 is shown in FIG. 1, it is noted that in other examples, the system 100 can include multiple fluid ejection devices that can communicate with the system controller 102 or a different system controller 102 in the system 100.

The fluid ejection device 104 includes a communication interface 110, which has multiple communication channel circuits 112. Depending on the type of system controller 102 that is included in the system 100, the number of communication channels in the communication path 106 can vary. For example, if a first type of system controller 102 is used, then there can be a first number of communication channels (one communication channel or multiple communication channels) in the communication path 106. If a second type of system controller 102 is used, then there can be a second number (different from the first number) of communication channels in the communication path 106, and so forth.

Each communication channel circuit 112 is to perform communications over a respective communication channel of the communication path 106. In some examples, the communication channel circuits 112 include communication channel receivers to receive data over corresponding communication channels of the communication path 106. For example, a communication channel receiver can include a bond pad (or other type of electrical contact or electrical connection structure) of the fluid ejection device 104 that is connected to a corresponding communication channel, where the bond pad can receive data over the communication channel. In further examples, a communication channel receiver can include additional or alternative circuitry, such as a buffer to store data, an amplifier to amplify data, and so forth. Although reference is made to the communication channel circuit 112 as including a communication channel receiver, it is noted that in further examples, a communication channel circuit 112 can additionally include a transmitter to transmit data over a corresponding communication channel.

The fluid ejection device 104 includes a configuration controller 114. The configuration controller 114 receives an input 116, which can be during operation of the system 100, during manufacture of the fluid ejection device 104, or at any other time. For example, during operation of the system 100, the system controller 102 can perform a write operation on the communication path 106 to provide the input 106 to the configuration controller 114. The input 116 can include information that is to be stored in a memory of the configuration controller 114, where the memory can be part of the configuration controller 114, or can be external of the configuration controller 114 but is accessible by the configuration controller 114. In further examples, if the input 116 is provided during manufacture of the fluid ejection device 104, then the input 116 can be supplied by a manufacturing equipment that is coupled to the fluid ejection device 104, to configure the fluid ejection device 104 by supplying the input 116 (including information) to be stored in the memory of the configuration controller 114.

The configuration controller 114 is responsive to the input 116 to selectively activate at least one communication channel circuit 112 of the multiple communication channel circuits 112 of the communication interface 110. Note that different inputs through the configuration controller 114 are to cause selective activation of different numbers of the multiple communication channel circuits 112.

The fluid ejection device 104 also includes a nozzle controller 118, which is to control ejection of fluids by the nozzles 108. The nozzle controller 118 is responsive to data 120 received through the activated at least one communication channel circuit 112 of the communication interface 110 to cause activation of at least one corresponding nozzle 108 to eject fluid. Although not shown in FIG. 1, there can be additional circuitry between the communication interface 110 and the nozzle controller 118, such as circuitry to deserialize data from a serial stream to a parallel format that is input to the nozzle controller 118.

The selective activation of the communication channel circuits 112 that is responsive to the input 116 can include activating a first subset of the communication channel circuits 112 while maintaining a second subset of the communication channel circuits 112 deactivated. Each of the first subset and second subset can include just one communication channel circuit 112 or multiple communication channel circuits 112. An activated communication circuit 112 is able to receive data over a communication channel. A deactivated communication circuit 112 does not receive data over a communication channel.

Figure 2A:
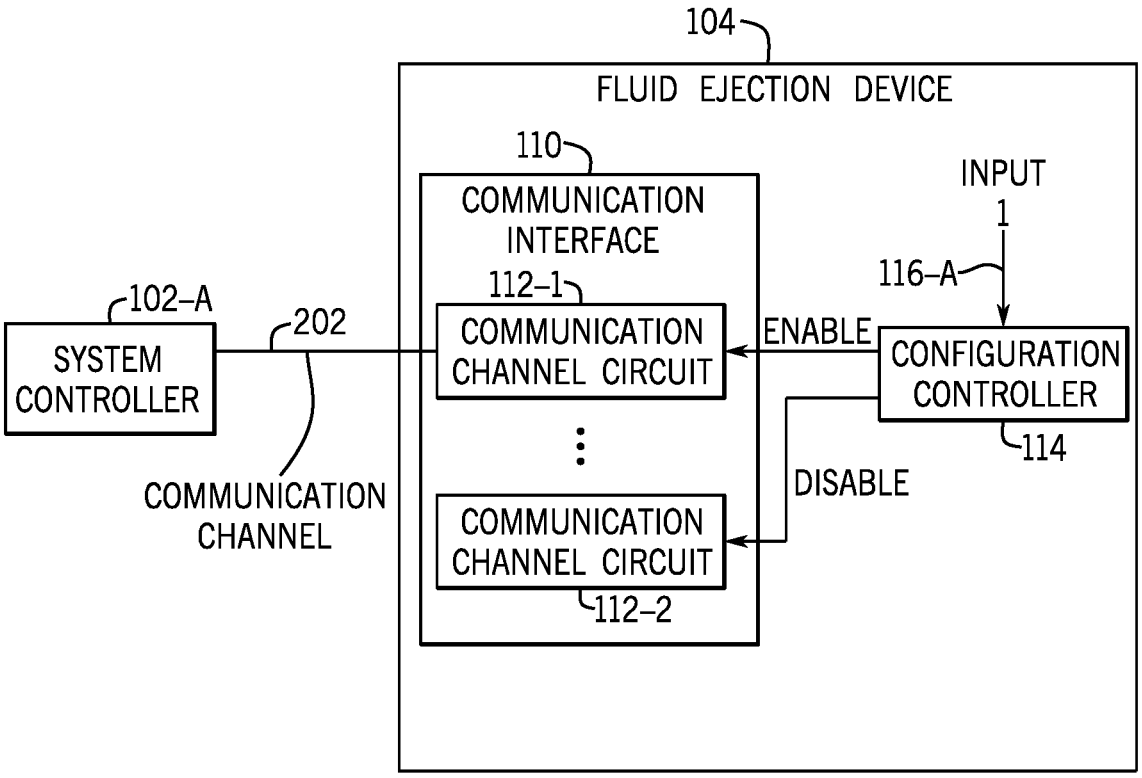
FIGS. 2A and 2B are block diagrams of arrangements including fluid ejection devices and system controllers, according to further examples.
Figure 2B:
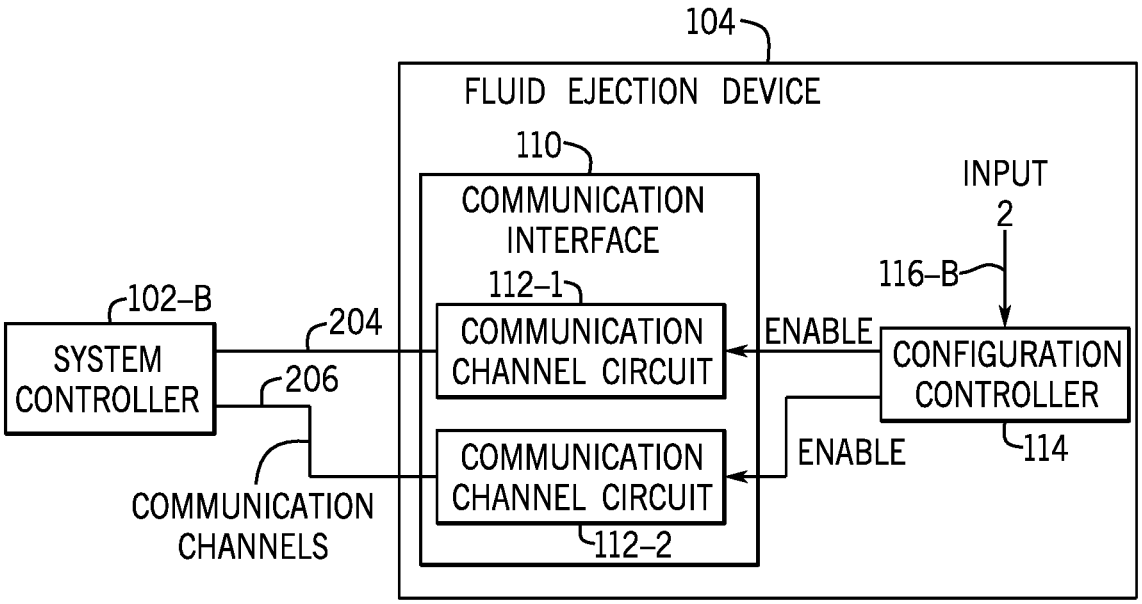

FIGS. 2A and 2B illustrate two examples in which the fluid ejection device 104 can be used with two different types of system controllers 102-A and 102-B, respectively. In FIG. 2A, it is assumed that the system controller 102-A communicates over just one communication channel 202 (of the communication path 106 of FIG. 1) with the fluid ejection device 104. In this example, in response to input 1 (116-A) received by the configuration controller 114, the configuration controller 114 asserts an enable indication to a first communication channel circuit 112-1 of the communication interface 110, and asserts a disable indication to a second communication channel circuit 112-2 of the communication interface 110. As a result, the communication channel circuit 112-1 is activated, while the communication channel circuit 112-2 remains deactivated. In some examples, enable indication and the disable indication can include an asserted state and a deasserted state, respectively, of a signal.

The communication interface 110 can include additional circuitry that can be used to connect a signal of any communication channel circuit 112 that is disabled to a reference voltage. For example, such additional circuitry can include a switch (e.g., implemented with a transistor) that can be turned on by the disable indication to connect the signal connected to the deactivated communication channel circuit 112-2 to a reference voltage. This switch can be turned off if the communication channel circuit 112-2 is activated; for example, the switch for the communication channel circuit 112-1 in FIG. 2A is turned off by the enable indication, so that the activated communication channel circuit 112-1 is not connect to a reference voltage. Driving the disabled communication channel circuit 112-2 to a reference voltage prevents a signal of the disabled communication channel circuit 112-2 from floating, which can cause undesirable effects.

In further examples, the disable indication can also be used to turn off (disable) some components of the disabled communication channel circuit 112-2, such as components (e.g., a data buffer, an amplifier, etc.) of a communication channel receiver of the communication channel circuit 112-2. The enable indication can turn on such components of the activated communication channel circuit 112-1.

FIG. 2B shows an example where the system controller 102-B communicates over two communication channels 204 and 206 with the fluid ejection device 104. In this case, the configuration controller 114 responds to input 2 (116-B) by asserting enable indications to both the communication channel circuits 112-1 and 112-2 of the communication interface 110, to activate the communication channel circuits 112-1 and 112-2.

Figure 3:
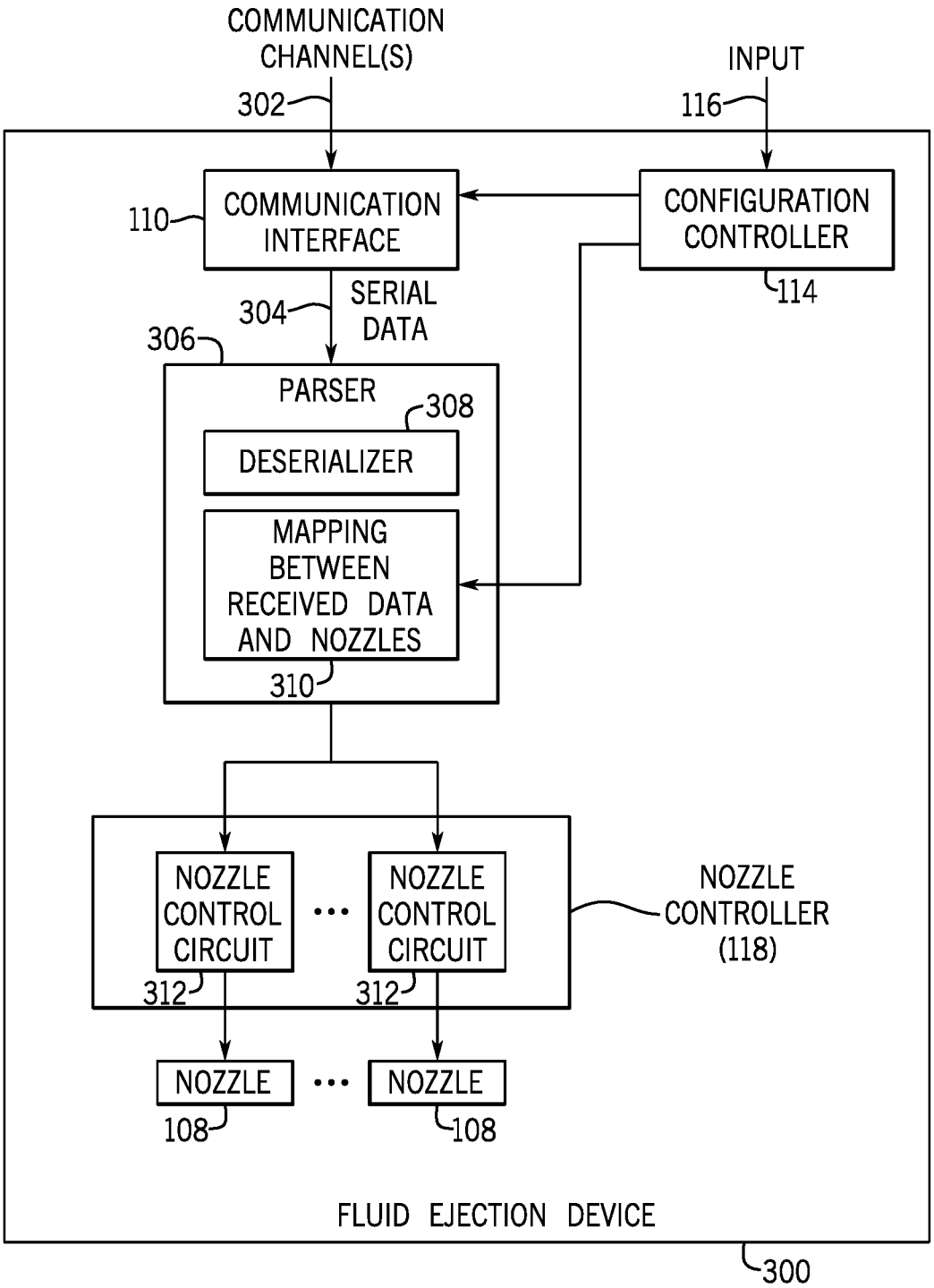
FIG. 3 is a block diagram of a fluid ejection device according to some examples.

FIG. 3 shows a fluid ejection device 300 according to further implementations. The fluid ejection device 300 receives data over a configurable communication path that includes a communication channel 302, or alternatively, multiple communication channels 302. In response to the input 116, the configuration controller 114 selectively activates at least one communication channel circuit of the communication interface 110. Data received over the communication channel(s) 302 is received by the at least one activated communication channel circuit and is provided as serial data 304 to a parser 306.

The parser 306 includes a deserializer 308 to deserialize the serial data 304 into parallel data. The parser 306 also includes a mapping 310 between received data and the nozzles 108 of the fluid ejection device 300. The mapping 310 is configured by the configuration controller 114, depending upon the number of communication channel(s) 302 that is (are) connected to the communication interface 110. For example, if multiple communication channels 302 are connected to the communication interface 110, then the mapping 310 can indicate that data received over a first communication channel is mapped to a first subset of the nozzles 108, while data received over a second communication channel is mapped to a second subset of the nozzles 108. On the other hand, if there is just one communication channel 302 connected to the communication interface 110, then the mapping 310 indicates that the received data is mapped to all of the nozzles 108.

The mapping 310 can include a data structure, such as a table or other data representation, to correlate data received over communication channel(s) to respective subset(s) of nozzles 108.

Mapping data received over a given communication channel to a collection of the nozzles 108 (either a subset of the nozzles 108 or all of the nozzles 108) refers to using the data received over a given communication channel to control selective activation of the collection of the nozzles 108 (but not nozzles that are not part of the collection). The data received over a given communication channel can address a particular nozzle or multiple particular nozzles in the collection; these addressed nozzle(s) in the collection of nozzles 108 is (are) activated, while the remaining non-addressed nozzle(s) in the collection of nozzles 108 is (are) not activated. Activating a nozzle causes activation of a fluid ejection element to eject fluid from a fluid ejection chamber of the nozzle.

The nozzle controller 118 includes nozzle control circuits 312 that control activation of the respective nozzles 108. In some examples, each nozzle control circuit 312 includes a memory element to store data that is received from the parser 306. A memory element can refer to an element of a register or other type of memory device. The stored data in the memory element of the nozzle control circuit 312 determines whether the corresponding nozzle 108 is to be activated. For example, if the stored data in the memory element has a first value, then the corresponding nozzle 108 is activated; on the other hand, if the stored data in the memory element has a second, different value, then the corresponding nozzle 108 is not activated.

The nozzle control circuit 312 also includes a fluid ejection element (e.g., a thermal resistor or a piezoelectric element), which when activated causes a corresponding fluid droplet to be ejected by the respective nozzle 108. A thermal resistor of the nozzle control circuit 312 causes heating of a fluid in a fluid ejection chamber of the nozzle 108, where this heating can vaporize the fluid in the fluid ejection chamber to cause ejection of a fluid droplet from an orifice of the nozzle 108. A piezoelectric element when activated moves to cause expulsion of fluid from the fluid ejection chamber through the orifice of the nozzle 108.

Figure 4:
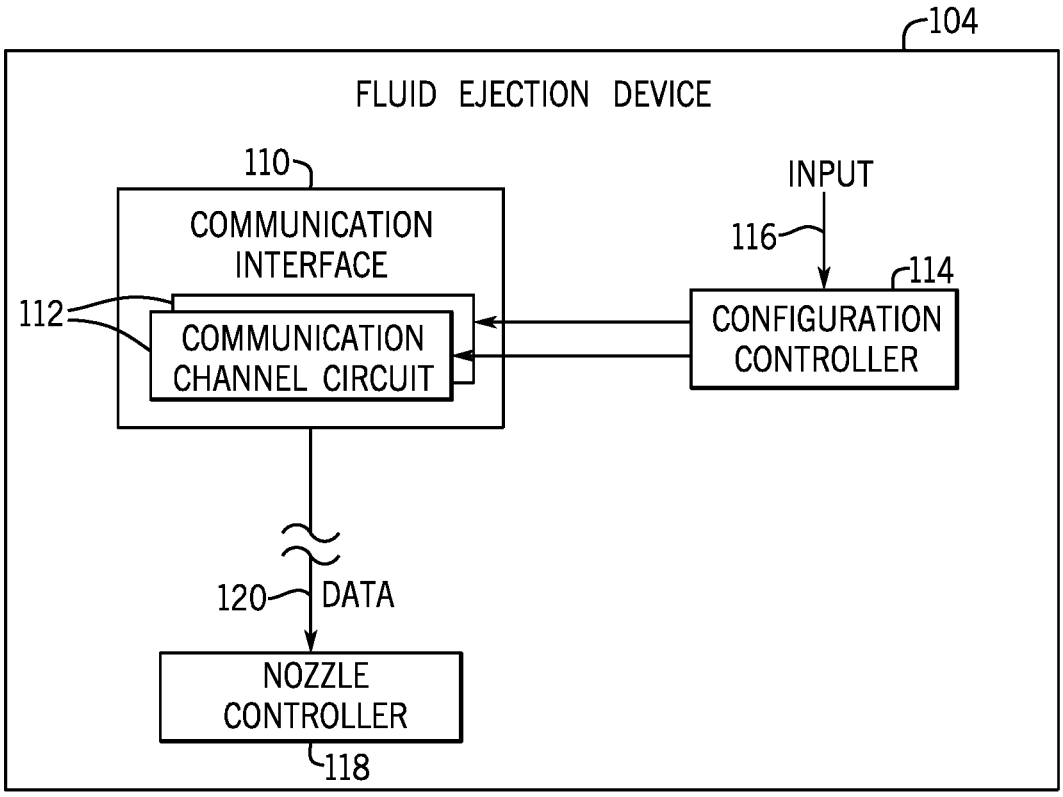
FIG. 4 is a block diagram of a fluid ejection device according to further examples.

FIG. 4 is a block diagram of a simplified view of the fluid ejection device 104, which includes the communication interface 110 having multiple communication channel circuits 112 capable of communicating over respective communication channels. The fluid ejection device 104 also includes the configuration controller 114, which is responsive to the input 116, to selectively activate at least one communication channel circuit 112. Different inputs to the configuration controller 114 are to cause selective activation of different numbers of the communication channel circuits 112.

The fluid ejection device 104 also includes the nozzle controller 118 that is responsive to the data 120 received through the activated at least one communication channel circuit 112 to cause activation of at least one corresponding nozzle to eject fluid.

Figure 5:
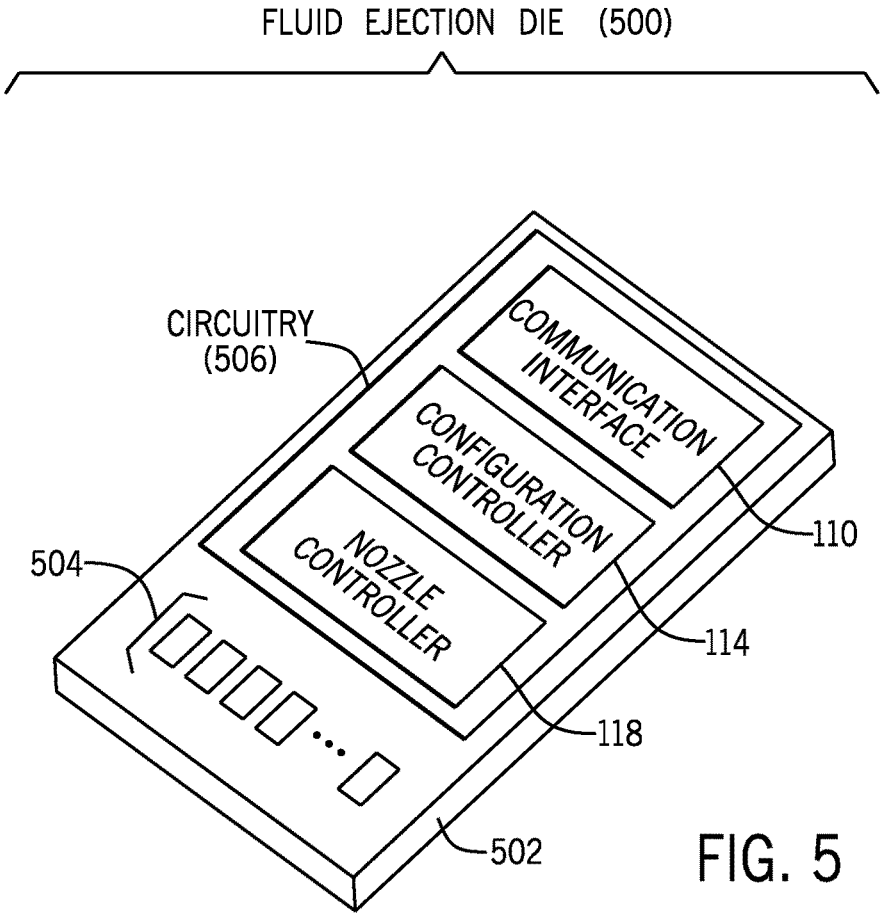
FIG. 5 is a block diagram of a fluid ejection die according to alternative examples.

FIG. 5 illustrates a fluid ejection die 500 according to further implementations. The fluid ejection die 500 includes a substrate 502, which can be formed of a material including silicon or another semiconductor material, or some other type of material. An array 504 of nozzles is formed on the substrate 502, and circuitry 506 for controlling the nozzles 504 is also formed on the substrate 502. The circuitry 506 includes the communication interface 110, the configuration controller 114, and the nozzle controller 118 as discussed above, according to some implementations.

Figure 6:
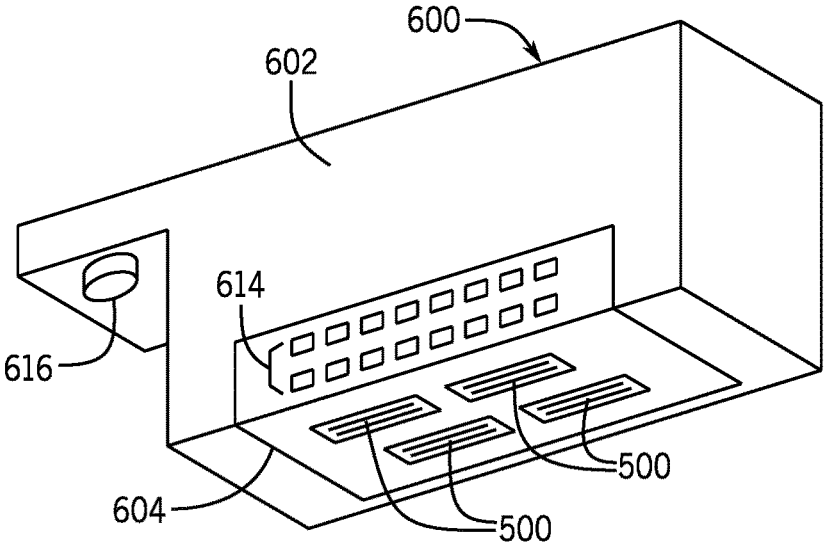
FIG. 6 is a schematic view of a cartridge according to further examples.

The fluid ejection die 500 according to some implementations (as discussed above) can be mounted onto a cartridge 600, as shown in FIG. 6. The cartridge 600 can be a print cartridge, for example, which can be removably mounted in a printing system. In other examples, the cartridge 600 can be another type of fluid ejection cartridge removably mounted in other types of systems.

The cartridge 600 has a housing 602 on which a fluid ejection device 604 can be mounted. For example, the fluid ejection device 604 can include a flex cable or other type of thin circuit board that can be attached to an external surface of the housing 602. The fluid ejection device 604 includes multiple fluid ejection dies 500 (FIG. 5).

The fluid ejection device 604 further includes electrical contacts 614 to allow the fluid ejection device 604 to make an electrical connection with another device (such as a system controller). In some examples, the cartridge 600 includes a fluid inlet port 616 to receive fluid from a fluid supply that is separate from the cartridge 600. In other examples, the cartridge 600 can include a fluid reservoir that can supply fluid to the die assemblies.

Figure 7:
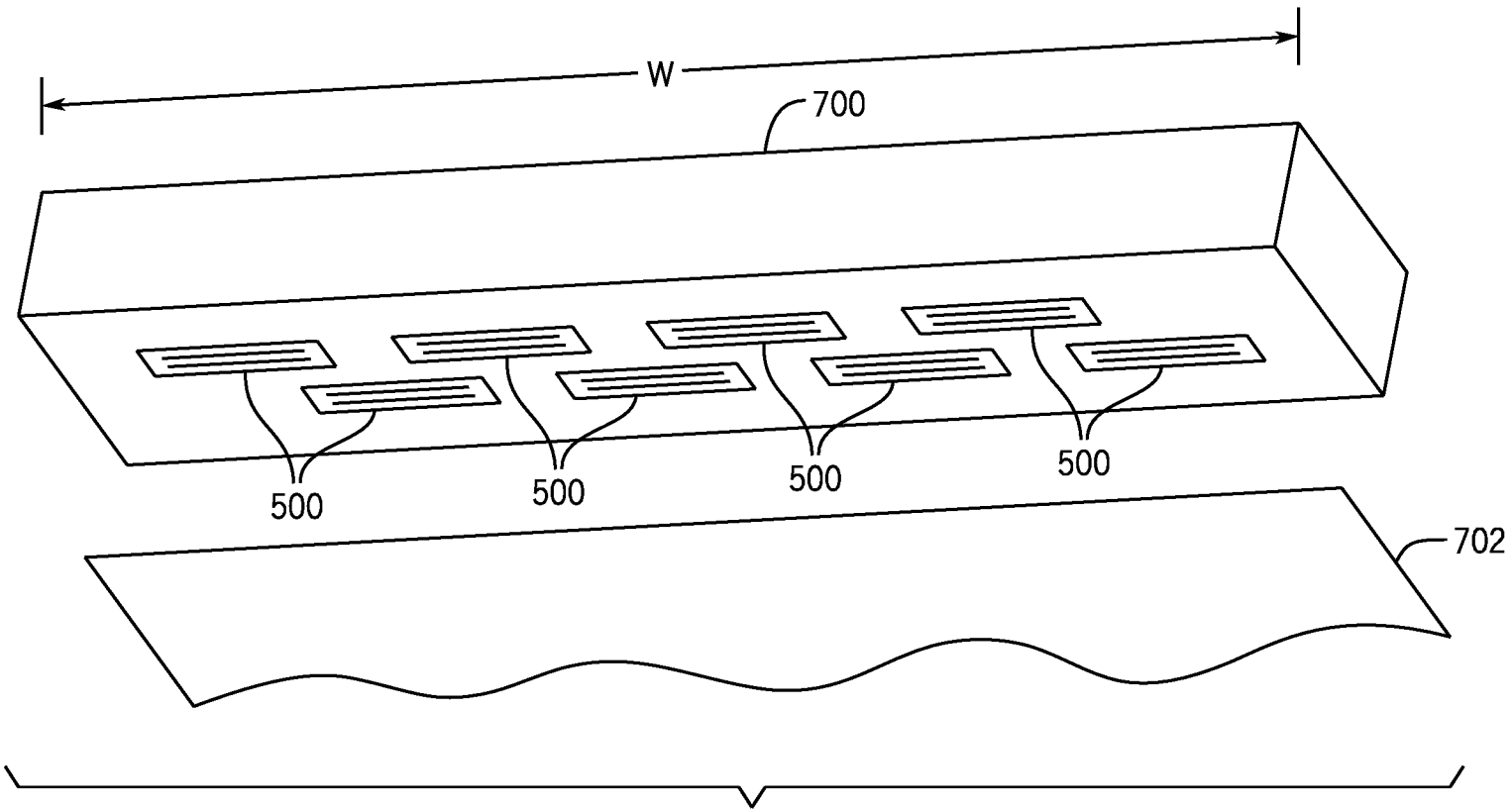
FIG. 7 is a schematic view of a bar according to other examples.

In further examples, fluid ejection die 500 according to some implementations can be mounted on a bar 700 (e.g., a print bar), such as shown in FIG. 7, where the bar 700 has a width W that allows the bar 700 to cover a width of a target 702 (e.g., a print medium) onto which fluids are to be dispensed by fluid ejection dies 500 that extend across the width of the bar 700.

As noted above, some example controllers (e.g., the configuration controller 114, the nozzle controller 118, etc.) can be implemented as a combination of a hardware processing circuit and machine-readable instructions executable on the hardware processing circuit. The machine-readable instructions can be stored in non-transitory machine-readable or computer-readable storage medium, which can include any or some combination of the following: a semiconductor memory device such as a dynamic or static random access memory (a DRAM or SRAM), an erasable and programmable read-only memory (EPROM), an electrically erasable and programmable read-only memory (EEPROM) and flash memory; a magnetic disk such as a fixed, floppy and removable disk; another magnetic medium including tape; an optical medium such as a compact disk (CD) or a digital video disk (DVD); or another type of storage device. Note that the instructions discussed above can be provided on one computer-readable or machine-readable storage medium, or alternatively, can be provided on multiple computer-readable or machine-readable storage media distributed in a large system having possibly plural nodes. Such computer-readable or machine-readable storage medium or media is (are) considered to be part of an article (or article of manufacture). An article or article of manufacture can refer to any manufactured single component or multiple components. The storage medium or media can be located either in the machine running the machine-readable instructions, or located at a remote site from which machine-readable instructions can be downloaded over a network for execution.

In the foregoing description, numerous details are set forth to provide an understanding of the subject disclosed herein. However, implementations may be practiced without some of these details. Other implementations may include modifications and variations from the details discussed above. It is intended that the appended claims cover such modifications and variations.

What is claimed is:

1. A fluid ejection device comprising:

a communication interface comprising a plurality of communication channel circuits capable of communicating data over respective communication channels;

a configuration controller, responsive to an input, to selectively activate at least one communication channel circuit of the plurality of communication channel circuits, wherein different inputs to the configuration controller are to cause selective activation of different numbers of the plurality of communication channel circuits, the different numbers of the plurality of communication channel circuits comprising a first number of communication channel circuits to communicate data with a data path controller external of the fluid ejection device over a respective first number of communication channels, and a second number of communication channel circuits to communicate data with a data path controller external of the fluid ejection device over a respective second number of communication channels, wherein the first number is smaller than the second number; and a nozzle controller responsive to data received through the activated at least one communication channel circuit to cause activation of at least one corresponding nozzle to eject fluid.

2. The fluid ejection device of claim 1, wherein the communication interface is to receive data over at least one communication channel that is connected to the activated at least one communication channel circuit.

3. The fluid ejection device of claim 1, further comprising:

a plurality of nozzles selectively activatable by the nozzle controller to eject fluid.

4. The fluid ejection device of claim 3, wherein the configuration controller is to control a mapping of data received by the communication interface to nozzles of the plurality of nozzles, depending upon which of the plurality of communication channel circuits have been activated by the configuration controller.

5. The fluid ejection device of claim 4, wherein the nozzle controller comprises respective memory elements to control corresponding nozzles of the plurality of nozzles.

6. The fluid ejection device of claim 5, wherein the nozzle controller further comprises fluid ejection elements to be activated based on data written to the memory elements, the fluid ejection elements when activated to cause ejection of fluid droplets from respective nozzles.

7. The fluid ejection device of claim 1, wherein the configuration controller comprises a memory to be written by a system comprising the fluid ejection device during operation of the system, the input controlling the selective activation of the at least one communication channel circuit comprising information written to the memory.

8. The fluid ejection device of claim 1, wherein the configuration controller comprises a memory to be written during manufacture of the fluid ejection device, the input controlling the selective activation of the at least one communication channel circuit comprising information written to the memory.

9. The fluid ejection device of claim 1, wherein the fluid ejection device is usable in any of a plurality of different types of systems that use respective different numbers of communication channels connected to the fluid ejection device.

10. The fluid ejection device of claim 1, comprising a printhead die, wherein the communication interface, the configuration controller, and the nozzle controller are part of the printhead die.

11. A fluid ejection die comprising:

a substrate;

an array of nozzles formed on the substrate; and circuitry formed on the substrate, the circuitry comprising:

a communication interface to communicate over a communication path, the communication interface comprising a plurality of communication channel receivers capable of communicating data over respective communication channels, a configuration controller, responsive to an input, to selectively activate at least one communication channel receiver of the plurality of communication channel receivers, wherein different inputs to the configuration controller are to cause selective activation of different numbers of the plurality of communication channel receivers, the different numbers of the plurality of communication channel receivers comprising a first number of communication channel receivers to communicate data with a data path controller external of the fluid ejection die over a respective first number of communication channels, and a second number of communication channel receivers to communicate data with a data path controller external of the fluid ejection die over a respective second number of communication channels, wherein the first number is smaller than the second number; and a nozzle controller to control ejection of fluids by nozzles of the array of nozzles, the nozzle controller responsive to data received through the activated at least one communication channel receiver to cause activation of at least one corresponding nozzle to eject fluid.

12. The fluid ejection die of claim 11, wherein a given communication channel receiver of the plurality of communication channel receivers that has not been activated by the configuration controller is driven to a reference voltage or is disabled.

13. The fluid ejection die of claim 11, wherein the configuration controller comprises a memory that is to store information corresponding to the input, and wherein the configuration controller is to selectively activate the at least one communication channel receiver of the plurality of communication channel receivers based on the information stored in the memory.

14. A system comprising:

a system controller to control dispensing of fluid to a target; and a fluid ejection device coupled over a communication path to the system controller, the fluid ejection device comprising:

nozzles to dispense fluid to the target;

a communication interface to communicate over the communication path with the system controller, the communication interface comprising a plurality of communication channel circuits capable of communicating data over respective communication channels in the communication path, a configuration controller, responsive to configuration information written to the configuration controller, to selectively activate at least one communication channel circuit of the plurality of communication channel circuits, wherein different configuration information written to the configuration controller are to cause selective activation of different numbers of the plurality of communication channel circuits, the different numbers of the plurality of communication channel circuits comprising a first number of communication channel circuits to communicate data with a first system controller external of the fluid ejection device over a respective first number of communication channels, and a second number of communication channel circuits to communicate data with a second system controller external of the fluid ejection device over a respective second number of communication channels, wherein the first number is smaller than the second number; and a nozzle controller to control ejection of fluids by the nozzles, the nozzle controller responsive to data received through the activated at least one communication channel circuit to cause activation of at least one corresponding nozzle to eject fluid.

15. The system of claim 14, wherein the system controller comprises a data path controller, and the fluid ejection device comprises a printhead die.

16. The fluid ejection device of claim 1, wherein each communication channel circuit of the plurality of communication channel circuits comprises a receiver to receive data.

17. The fluid ejection device of claim 1, wherein each communication channel circuit of the plurality of communication channel circuits comprises an electrically conductive contact to receive data.

18. The fluid ejection device of claim 1, wherein the configuration controller is to, responsive to the input, to selectively maintain at least one communication channel circuit of the plurality of communication channel circuits inactive.

19. The fluid ejection die of claim 11, wherein the configuration controller comprises a memory to be written during manufacture of the fluid ejection die, the input controlling the selective activation of the at least one communication channel receiver comprising information written to the memory.

20. The system of claim 14, wherein the configuration controller comprises a memory to be written during manufacture of the fluid ejection device, the configuration information controlling the selective activation of the at least one communication channel circuit comprising information written to the memory.

* * * * *